United States Patent [19]

Obayashi et al.

[11] 3,982,460

[45] Sept. 28, 1976

[54] MUSICAL-TONE-WAVEFORM FORMING APPARATUS FOR AN ELECTRONIC MUSICAL INSTRUMENT

[75] Inventors: Nobuharu Obayashi; Hikaru Hashizume; Noriji Sakashita; Seiji Kameyama; Sadaaki Ezawa; Toshio Kugisawa; Yutaka Washiyama; Tatsunori Kondo; Hironori Watanabe, all of Hamamatsu, Japan

[73] Assignee: Kabushiki Kaisha Kawai Gakki Seisakusho, Hamamatsu, Japan

[22] Filed: Sept. 16, 1975

[21] Appl. No.: 613,931

[30] Foreign Application Priority Data

Sept. 17, 1974 Japan ..... 49-107401

[52] U.S. Cl. ..... 84/1.03; 84/1.01; 84/1.24

[51] Int. Cl.[2] ..... G10F 1/00

[58] Field of Search ..... 84/1.01, 1.03, 1.04, 84/1.11, 1.19, 1.24, 1.26, 1.28; 332/9, 16

[56] References Cited

UNITED STATES PATENTS

| | | | |
|---|---|---|---|
| 3,515,792 | 6/1970 | Deutsch | 84/1.03 |
| 3,742,755 | 7/1973 | Watson | 84/1.01 |
| 3,763,364 | 10/1973 | Deutsch et al. | 84/1.03 |
| 3,809,789 | 5/1974 | Deutsch | 84/1.19 |
| 3,882,751 | 5/1975 | Tomisawa et al. | 84/1.01 |
| 3,895,553 | 7/1975 | Kawamoto | 84/1.24 |

*Primary Examiner*—L. T. Hix
*Assistant Examiner*—Vit W. Miska
*Attorney, Agent, or Firm*—Haseltine, Lake & Waters

[57] ABSTRACT

An apparatus for forming a musical-tone waveform for an electronic musical instrument characterized in that at least one cycle of a musical-tone waveform, which it is desired be produced, is divided in amplitude by dividing lines at equal intervals and sampling points on a time axis are determined from respective crossing points between the waveform and the dividing lines and the distance between the initial and the final sampling points is represented by an appropriate number of pulses so that each sampling point may be represented by a pulse number. There is further provided a memory circuit wherein each sampling point, that is, the pulse number thereof is set up in the form of a digital signal. Additionally, there is a set up in the form of a digital signal a tendency such as increase, decrease or equal at each sampling point with reference to the preceding sampling point. An envelope setting device is used wherein the envelope of a muscial-tone waveform, which it is desired be produced, is subjected to sampling and the analog amount of each sampling point is set up in the form of digital signal. An accumulatively adding device is employed whereby the output digital signal of the envelope setting device is accumulatively added to or subtracted from the output digital signal of the memory circuit. The accumulatively adding device is connected at its output terminal to a D-A converter for converting its output signal into an analog signal.

14 Claims, 19 Drawing Figures

MUSICAL-TONE-WAVEFORM FORMING APPARATUS FOR AN ELECTRONIC MUSICAL INSTRUMENT

FIELD OF THE INVENTION

This invention relates to apparatus for forming a musical-tone signal for an electronic musical instrument.

BACKGROUND

It has been heretofore conventional that the forming of a musical-tone signal for an electronic musical instrument is effected by forming a musical-tone signal waveform and passing the same through an envelope circuit to obtain a musical-tone signal having a specific envelope.

This envelope circuit requires a condenser and is defective in that the condenser may be rather large in size. As a result of the necessity of limiting the capacity for that reason, available envelopes are limited to those within a certain range and many envelopes which characterize various natural musical instruments or which have to be specially created cannot be formed as occasion demands.

SUMMARY OF THE INVENTION

This invention has as an object the provision of an apparatus free from the above defect.

According to this invention, at least one cycle of a musical-tone waveform to be produced is divided in amplitude by dividing lines at equal intervals and sampling points on a time axis are determined from respective crossing points between the waveform and the dividing lines and the distance between the initial and the final sampling points is represented by an appropriate number of pulses so that each sampling point may be represented by a pulse number. Also provided is a memory circuit wherein each sampling point, that is, the pulse number thereof, is set up in the form of a digital signal and, additionally, there is set up a tendency such increase, decrease or equal at each sampling point with reference to the preceding sampling point in the form of a digital signal. An envelope setting device wherein the envelope of a musical-tone waveform, which it is desired be produced, is subjected to sampling and the analog amount of each sampling point is set up in the form of a digital signal. An accumulatively adding device is employed whereby an output digital signal of the envelope setting device is accumulatively added to or subtracted from an output digital signal of the memory circuit. The adding device is connected at its output terminal to a D-A converter for converting its output signal into an analog signal.

DETAILED DESCRIPTION

Figure 1:
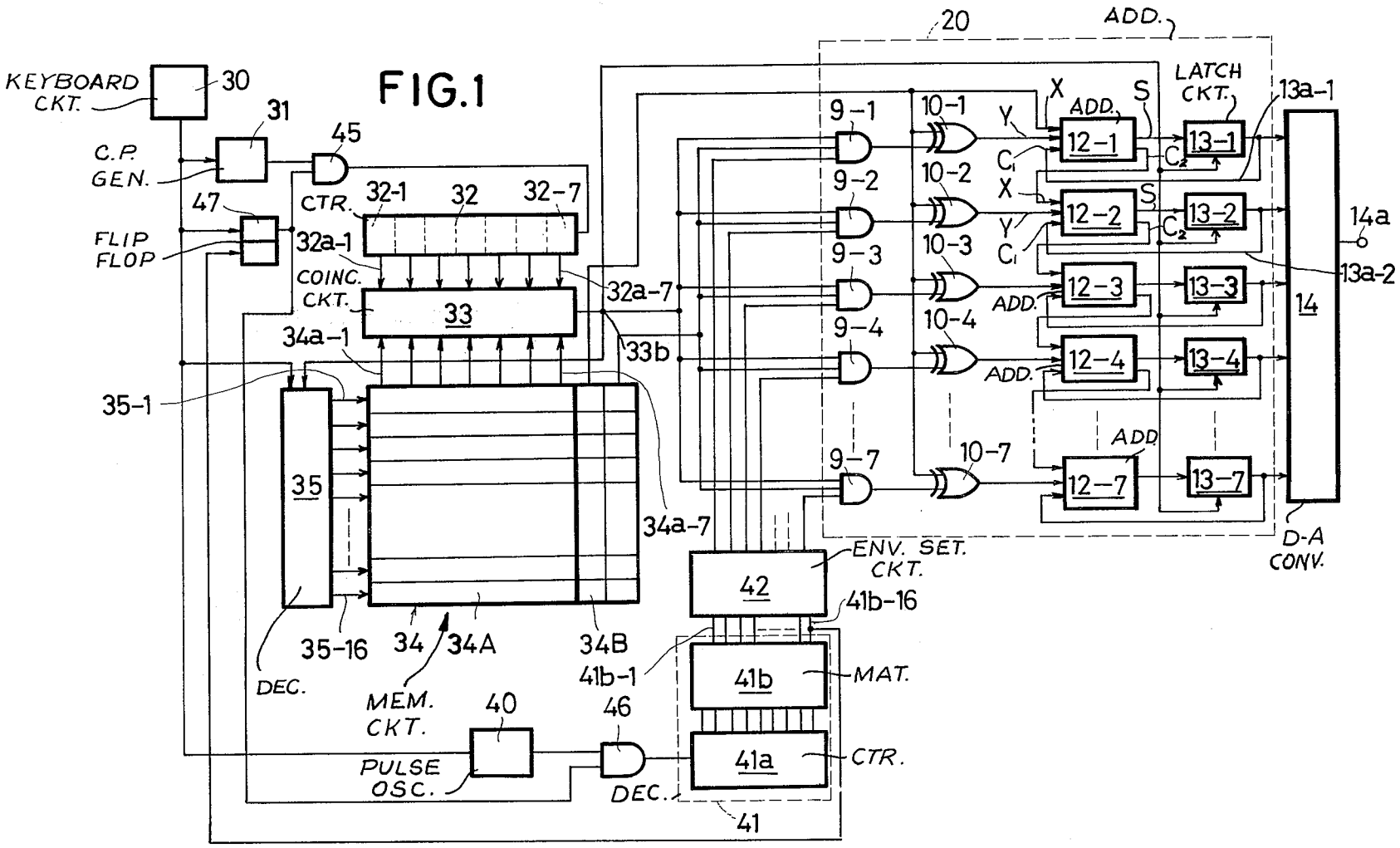
FIG. 1 is a block diagram showing one embodiment of this invention.

In FIG. 1, circuit 30 is a keyboard circuit which generates an output signal on depression of a key. Circuit 31 is a clock-pulse oscillator or generator which is driven by the output signal of keyboard circuit 1 and oscillates with a frequency corresonding to that of the musical tone selected by the depressed key. Circuit 32 is a counter which counts the output pulses of the clock pulse generator 31. Circuit 32 comprises a plurality of flip-flop circuits 32-1 . . . 32-7. A plurality of output terminals 32*a*-1 . . . 32*a*-7 lead out from the flip-flop circuits 32-1 . . . 32-7 and are connected to one group of input terminals of the coincidence circuit 33.

Circuit 34 is a memory circuit, which comprises a portion 34A wherein sampling points on a time axis of a musical tone waveform desired to be produced are set up and a portion 34B wherein "tendencies" such as increase, decrease or equal of the musical-tone waveform at respective sampling points are set up. Portions 34A and 34B are composed of read-only memories as described in detail hereinafter. A plurality of output terminals 34*a*-1 . . . 34*a*-7 are connected to a second group of input terminals of the coincidence circuit 33.

Figure 2:
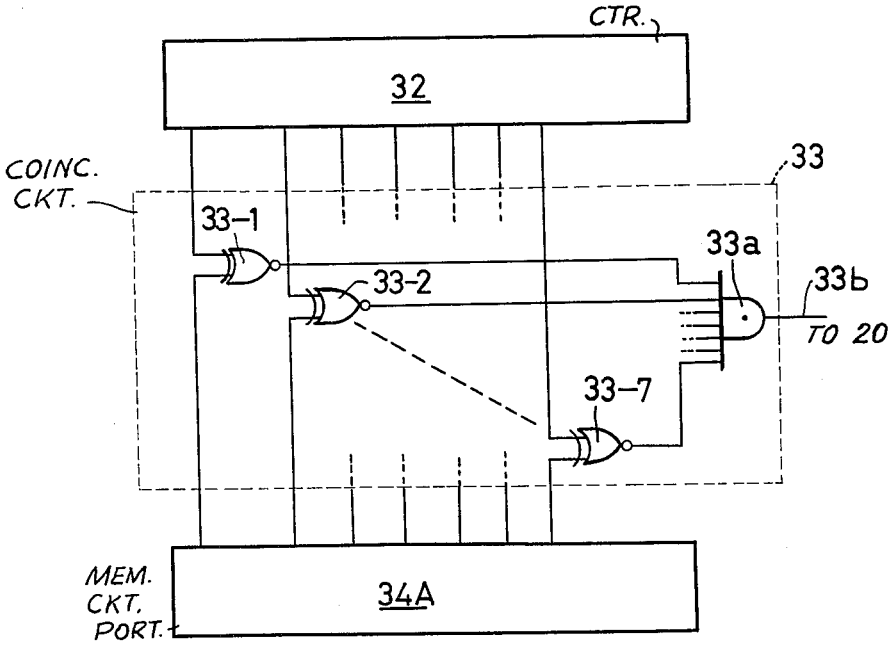
FIG. 2 is a detailed circuit diagram of one of the blocks of FIG. 1.

The coincidence circuit 33 comprises, as shown in FIG. 2, a plurality of exclusive-NOR circuits 33- 1 . . . 33-7 and a single AND circuit 33a connected to output terminals thereof. The exclusive-NOR circuits 33-1 . . . 33-7 respectively have two input terminals. One group thereof is connected to respective and corresponding order output terminals 32*a*-1 . . . 32*a*-7 of the counter 32. The other group thereof is connected to respective and corresponding order output terminals 34*a*-1 . . . 34*a*-7 of the memory circuit portion 34A. Thus, when a digital signal from the counter 32 and a digital signal from the portion 34A coincide with one another, an output signal "1" is obtained at output terminal 33*b* of the AND circuit 33A.

Circuit 35 is a decoder which is connected to the output terminal 33*b* and comprises, for instance, a ring counter. The decoder 35 has a plurality of output terminals 35-1 . . . 35-16 and these output terminals 35-1 . . . 35-16 are connected to the memory circuit 34.

Figure 3:
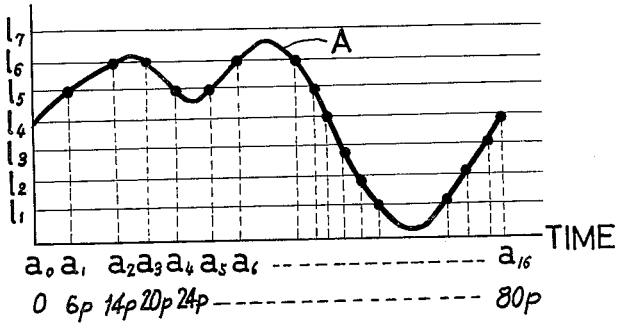
FIG. 3 is a diagram showing a musical tone waveform desired to be produced.

FIG. 3 is a chart or graph which shows a musical-tone waveform, which it is desired be produced. This musical-tone waveform A is divided in amplitude by dividing lines $1_1 \ldots 1_7$ at equal intervals. Perpendicular lines drawn downwards from respective crossing points between the dividing lines $1_1 \ldots 1_7$ and the musical-tone waveform A determine sampling points $a_1 \ldots a_{16}$ on the time axis of the graph. The final sampling point $a_{16}$ is assumed to be characterized by, for instance, a number of pulses equal to 80. Thus, the analog amounts, that is, the pulse numbers of the respective sampling points $a_1$. . . $a_{16}$ starting from the zero point are respectively 6,14,20 . . . 80. These analog amounts are represented by digital numbers of the binary scale and are set up in the portion 34A of the memory circuit 34.

Figure 4:
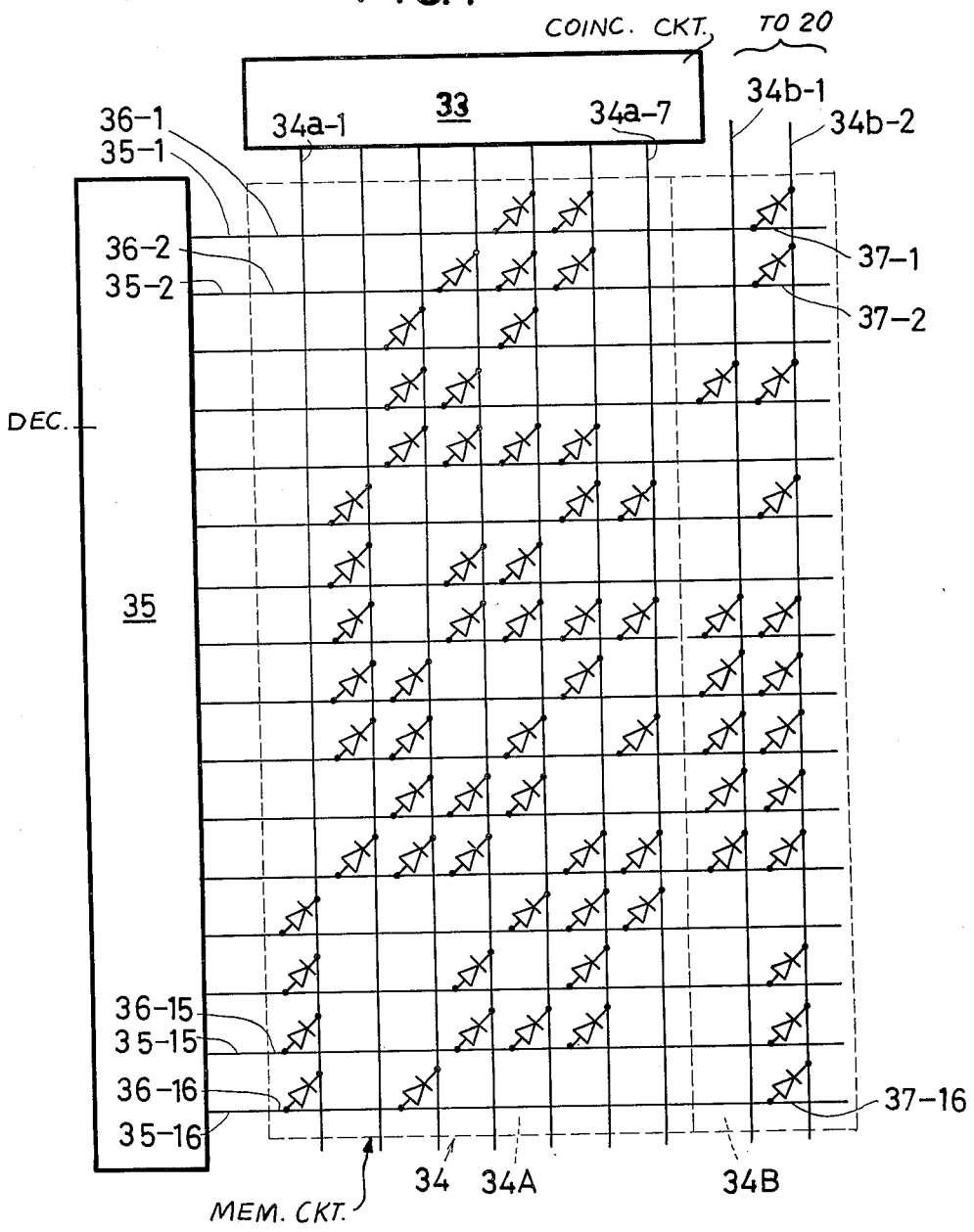
FIG. 4 is a detailed circuit diagram of another block.

A specific circuit diagram of the portion 34A is shown in FIG. 4. The portion 34A comprises sixteen words of seven bits, and input conductors 36-1 . . . 36-16 for these words are connected to the output terminals 35-1 . . . 35-16 of the decoder 35. By signals obtained in order at output terminals 35-1 . . . 35-16, the respective words are selected in order for being sent out as digital signals in order from the output terminals 34*a*-1 . . . 34*a*-7 thereof.

As mentioned above, the portion 34B of the memory circuit serves for the settng up of such tendencies as increase, decrease or equal of the musical-tone waveform, in accordance with the following truth table.

| | 34b-1 | 34b-2 |
|---|---|---|
| INCREASE | 0 | 1 |
| DECREASE | 1 | 1 |
| EQUAL | 0 | 0 |

The waveform A is examined as to such tendencies of its respective portions between the sampling points $a_1$ . . . $a_{16}$ and the preceding sampling points $a_0$ . . . $a_{15}$. The portion 34B is set up accordingly in accordance with the foregoing table, as shown in FIG. 4. Input conductors 37-1 . . . 37-16 of the respective words of the portion 34B are connected to the input conductors 36-1 . . . 36-16 of the words of the portion 34A. Thus, the respective right and left words are simultaneously selected by signals obtained at the output terminals 35-1 . . . 35-16 of the decoder 35. Output conductors 34*b*-1, 34*b*-2 of the portion 34B are connected to an accumulatively adding device 20 mentioned in detail hereinafter.

Circuit 40 (FIG. 1) is a pulse oscillator for determining the envelope of a musical-tone waveform A, which it is desired be produced. An output terminal thereof is connected to a decoder 41. The decoder 41 comprises a counter 41*a* and a diode matrix circuit 41*b* and the circuit is so arranged that output signals are generated in order at a plurality of output terminals 41*b*-1 . . . 41*b*-16 of the diode martix circuit 41*b*. Decoder 41 has the same operation as the blocks 1 and 2 in U.S. Pat. No. 3,752,898 and acts equally as a ring counter.

Figure 5:
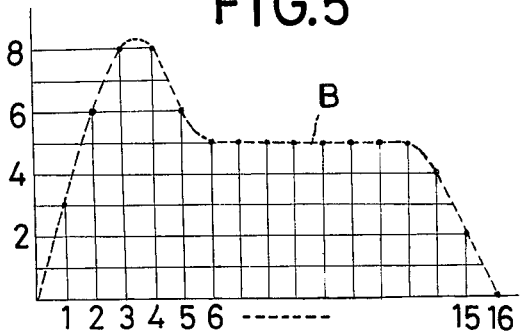
FIG. 5 is a diagram showing an envelope desired to be produced.
Figure 6:
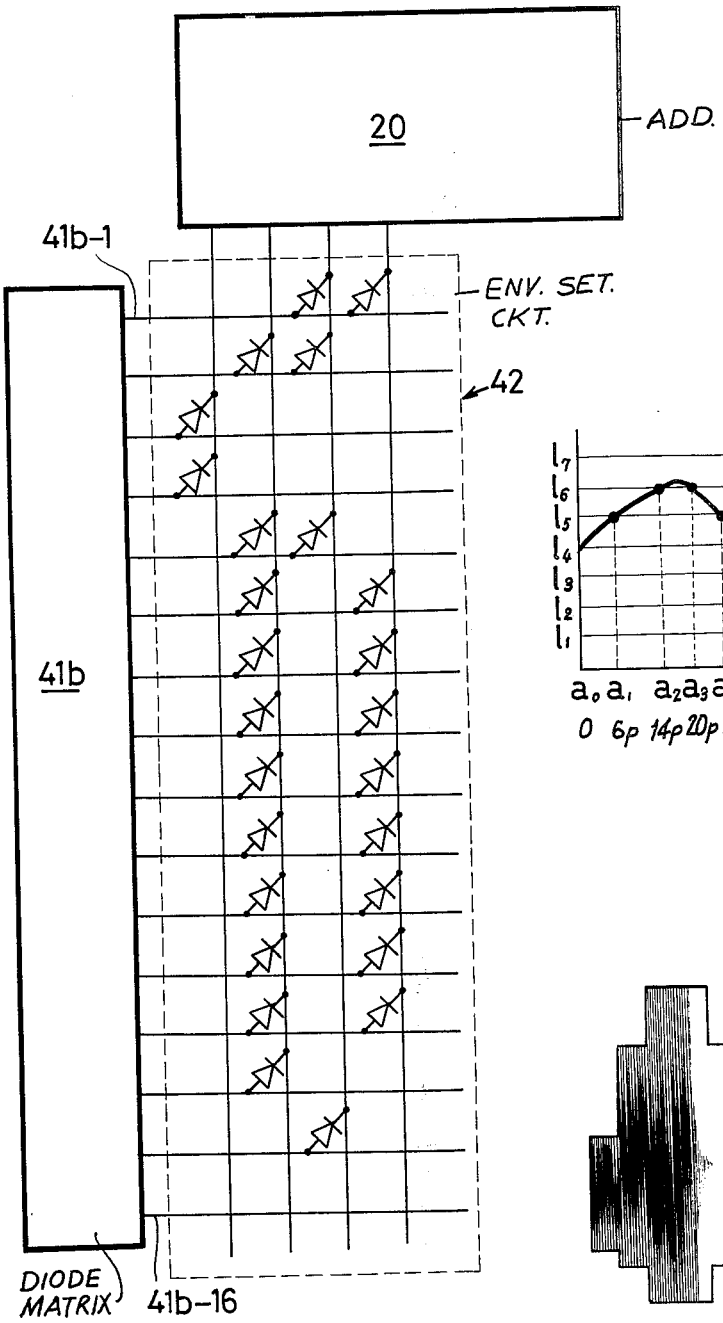
FIG. 6 is a detailed circuit diagram of another block.

Circuit 42 is an envelope setting circuit connected to the output terminals 41*b*-1 . . . 41*b*-16 of the decoder 41 and comprises a read-only memory as mentioned hereinafter in detail. FIG. 5 shows the envelope B of a musical-tone wave form, which it is desired to be produced. This envelope B is subjected to sampling at its time axis and analog amounts of heights thereof at respective sampling points 1,2 . . . 16 are converted into digital signals of the binary scale and are set up in a read-only memory, that is, at respective addresses of the envelope setting device 42. The result thereof is as shown in FIG. 6, wherein, among the seven bits thereof, the leftmost three bits which are each always "0" are omitted.

The clock pulse generator 31, the pulse oscillator 40 and the decoder 35 are connected to the keyboard circuit 30 so that, when a key is depressed, the oscillators 31 and 40 start to oscillate simultaneously and the decoder 35 provides a signal at the first output terminal 35-1 for designating the first address of the memory circuit 34.

The construction of the accumulatively adding device 20 is next described with reference to FIG. 1. It comprises a plurality of AND circuits 9-1 . . . 9-7, a plurality of exclusive OR citcuits 10-1 . . . 10-7, a plurality of full adders 12-1 . . . 12-7 and a plurality of latch circuits 13-1 . . . 13-7, all connected as shown in FIG. 1. Output terminals of the latch circuits 13-1 . . . 13-7 are connected to a D-A converter 14. An output terminal 14*a* thereof is connected to a speaker through a filter, an amplifier and so forth (not shown). Each latch circuit 13-1 . . . 13-7 is constructed to be operated by an output signal of the coincidence circuit 33 (that is, by a falling portion of the output signal which is of rectangular form) and memorizes the existing input signal and sends out the same as an output. The decoder 35 is also operated by the falling portion of the coincidence signal to produce an output signal at the next order output terminal thereof.

In order that when, by depression of a key, a musical-tone waveform will be formed repeatedly and an envelope of a musical tone will be formed and that such a repeated waveform forming may be stopped, the following construction is used. AND circuits 45 and 46 are interposed in the circuit connecting the clock pulse generator 31 and the counter 32 and the circuit connecting the pulse oscillator 40 and the decoder 41, respectively. The control terminals thereof are connected to an output terminal of the flip-flop circuit 47, the set terminal of the flip-flop circuit 47 is connected to an output terminal of the keyboard circuit 30 and the reset terminal thereof is connected to the final output terminal 41*b*-16 of the decoder 41.

The full adders 12-1 . . . 12-7 have respective input terminals X, Y and $C_1$ and respective output terminals S and $C_2$. They operate according to the following table:

| Inputs | | | Outputs | |
|---|---|---|---|---|
| X | Y | $C_1$ | S | $G_2$ |
| 0 | 0 | 0 | 0 | 0 |
| 1 | 0 | 0 | 1 | 0 |
| 0 | 1 | 0 | 1 | 0 |
| 0 | 0 | 1 | 1 | 0 |
| 1 | 1 | 0 | 0 | 1 |
| 1 | 0 | 1 | 0 | 1 |
| 0 | 1 | 1 | 0 | 1 |
| 1 | 1 | 1 | 1 | 1 |

If a key is depressed, the clock pulse generator 31 and the pulse oscillator 40 are actuated and the AND gates 45 and 46 are opened. A signal obtained at the first output terminal 35-1 of the decoder 35 selects the first address of the memory circuit 34.

The first pulse generated by the pulse oscillator 40 is taken out as an output signal through the decoder 41 from the first output terminal 41*b*-1 thereof and selects the first address of the envelope setting circuit 42. The word "0000011" of the first address of the envelope setting circuit 42 is applied to the AND circuits 9-1 . . . 9-7. The word "0000110" of the first address of the portion 34A of the memory circuit 34 is applied to the coincidence circuit 33, and the "0" of the word "01" of the portion 34B is applied through the output terminal 34*b*-1 to the input terminals on one side of the exclusive-OR circuits 10-1 . . . 10-7 and the "1" of the same is applied through the output terminal 34*b*-2 to the AND circuits 9-1 . . . 9-7. Under these conditions, the output of the AND circuits 9-1 . . . 9-7 and that of the exclusive-OR circuits 10-1 . . . 10-7 are "0000000" and accordingly the output of the latch circuits 13-1 . . . 13-7 is also "0000000". Thus, the output of the D-A converter 14 is also "0".

The counter 32 counts output pulses of the clock pulse oscillator 31 and sequentially generates output signals "0000001", "0000010", "0000011" . . . . When the counter 32 counts six pulses and generates the output signal "0000110", this signal coincides at the coincidence circuit 33 with the output signal "0000110" from the first word of the portion 34A of the memory circuit 34, whereby there is obtained from the coincidence circuit 33 a first coincidence signal "1". This coincidence signal is directly applied to the AND circuits 9-1 . . . 9-7. An output signal "000011" is generated by the AND circuits 9-1 . . . 9-7 and is applied to the exclusive-OR circuits 10-1 . . . 10-7. Because, in the meanwhile, the output signal "0" of the output terminal 34*a*-1 is applied to the exclusive-OR circuits 10-1 . . . 10-7, the output thereof becomes "0000011". This output signal "0000011" is applied to the Y terminals of the full adders 12-1 . . . 12-7. These full adders 12-1 . . . 12-7 operate according to the operational characteristic features as shown in the foregoing table and provides an output "0011". If, then, the first coincidence signal offers its lowering portion, the latch circuits 13-1 . . . 13-7 are operated by the falling portion and memorize the signal "0000011" and at the same time send out the memorized signal. This signal "0000011" is converted into the analog amount "3" through the D-A converter 14. This output signal "0000011" is retained until a second coincidence signal is generated by the coincidence circuit 33 and the latch circuits 13-1 . . . 13-7 are operated thereby. The output signal "0000011" is returned to be applied to the input terminals $C_1$ of the full adders 12-1 . . . 12-7 through feed-back conductors 13*a*-1 . . . 13*a*-7.

The first coincidence signal "1" operates at the time of generation of its falling portion, the decoder 35, so that an output signal is generated at the second output terminal thereof and the second address of the memory circuit 34 is selected. Thus, a signal "0001110" is generated from the portion 34A and a signal "01" is sent out from the portion 34B. The counter 33 counts, following the counting of six input pulses, the seventh pulse, the pulse, the eighth pulse, the ninth pulse . . . , and generates "0000111", "0001000", "0001001" . . . , and when fourteen pulses are counted thereby, the output signal thereof becomes "0001110" and coincides with an output signal "0001110" from the portion 34A, whereby there is generated a second coincidence signal "1". The output of the AND circuits 9-1 . . . 9-7 becomes "0000011" and the output of the OR circuits 10-1 . . . 10-7 becomes "0000011". This output "0000011" is applied to the input terminals Y of the full adders 12-1 . . . 12-7. Thus, this signal and its feed-back signal are added at the full adders 12-1 . . . 12-7 according to the table mentioned before, whereby there is obtained an output "00000110". This output "0000110" is memorized in and sent out from the latch circuits 12-1 . . . 12-8 at the falling portion of the second coincidence signal, and there is obtained an analog amount "6" through the D-A converter 14. This output "00000110" is retained and also is fed back to the full adders 12-1 . . . 12-7 through the feed-back conductors 13*a*-1 . . . 13*a*-7 until a third coincidence signal is generated similarly as above. The decoder 35 is operated by the falling portion of the second coincidence signal and an output signal is obtained at the third output terminal thereof and the third adders of the memory circuit 34 are selected.

A signal "0010100" is generated from the portion 34A, and an EQUAL signal "00" is generated from the portion 34B. A third coincidence signal is taken out if the counter 33 generates an output signal "0010100", and the output of the AND circuits 9-1 . . . 9-7 becomes "0000000" and the output of the exclusive-OR circuits 10-7 . . . 10-7 also becomes "0000000". Thus, an output "0000110", which is the same as the output "0000110" of the latch circuits 13-1 . . . 13-7, is taken out from the full adders 12-1 . . . 12-7. Thus, at the occurrence of the falling portion of the third coincidence signal, the output "0000110" is memorized in and sent out from the latch circuits 13-1 . . . 13-7.

The fourth address of the memory circuit 34 is selected by the falling portion of the third coincidence signal, and "0011000" it taken out from the portion 34A and a DECREASE signal "11" is taken out from the portion 34B. If then an output of the counter 32 is in coincidence with the output of the portion 34A at the coincidence circuit 33, a fourth coincidence signal is generated, whereby the output of the AND circuits 9-1 . . . 9-7 becomes "0000011" and the output of the full adders 12-1 . . . 12-7 becomes "0001100". Upon occurrence of the falling portion of the fourth coincidence signal, this output is memorized in and sent out from the latch circuits 13-1 . . . 13-7. The same is D-A converted to obtain the analog amount "3".

At the falling portion of the fourth coincidence signal, the fifth address of the memory circuit 34 is selected, whereby "0011110" is taken out from the portion 34A and "00" is taken out from the portion 34B. If, then, the output of the portion 34A coincides at the coincidence circuit 33 with an output of the counter 32, a fifth coincidence signal "1" is generated, whereby a signal "0000000" obtained through the AND circuits 9-1 . . . 9-7 and the exclusive-OR circuits 10-1 . . . 10-7 is applied to the full adders 12-1 . . . 12-7 along with an output signal of the latch circuits 13-1 . . . 13-7. Thereby there is obtained an output "0000011". If, then the fifth coincidence signal is brought to its falling portion, this output signal "0000011" is memorized in and sent out from the latch circuits 13-1 . . . 13-7 and is D-A converted to obtain an analog amount "6". Upon the falling portion of this fifth coincidence signal, the decoder 35 is operated to select the sixth address of the memory circuit 34. Thereby, "0100011" and "01" are taken out from the portion 34A and the portion 34 B. If, then, a sixth coincidence signal is generated by a coincidence at the coincidence circuit 33, the output of the exclusive-OR circuits 10-1 . . . 10-7 becomes "0000011" and a signal "0000011" memorized in the latch circuits 13-1 . . . 13-7 is applied through the feed-back circuits 13*a*-1 . . . 13*a*-7 to the input sides of the full adders 12-1 . . . 12-7, whereby the output of the full adders 12-1 . . . 12-7 becomes "00000110" and is D-A converted to obtain the analog amount "6".

Figure 7:
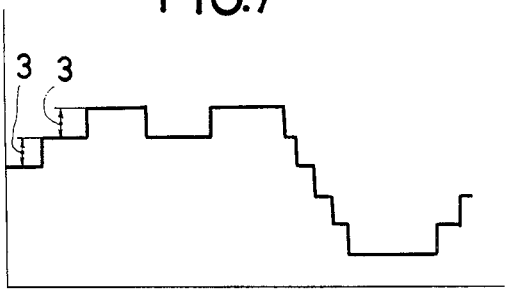
FIGS. 7 and 8 are diagrams showing resultant musical tone waveforms.

Thus, each time a coincidence signal is generated at the coincidence circuit, the output signal "0000011" of the envelope setting device 42 and the output signal of the latch circuits 13-1 . . . 13-7 are added or subtracted at the accumulatively adding device 20 according to the tendence signal INCREASE, DECREASE or EQUAL of the portion 34B of the memory circuit 34, whereby there is obtained a stepped form of musical tone waveform, of which the magnitude of each step is the analog amount 3 as shown in FIG. 7. This waveform is repeatedly formed until the pulse oscillator 40 generates a second pulse.

Figure 8:
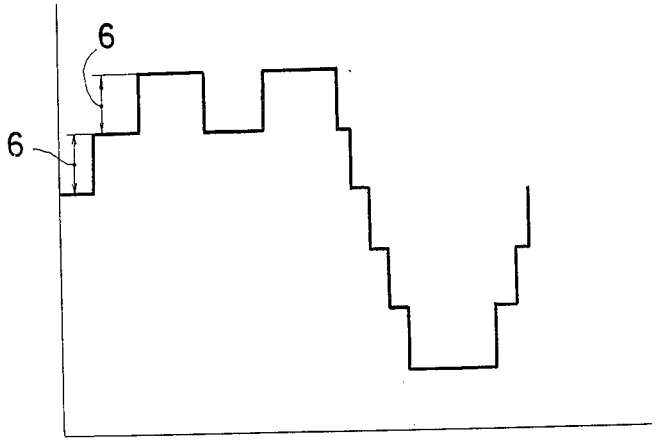

When the second pulse is generated by the pulse oscillator 40, the second address of the envelope setting device 42 is selected and there is obtained an output "0000110" as is clear from FIGS. 5 and 6. Thus, as above, each time when a coincidence signal is generated by the coincidence circuit 33, the output signal "0000110" of the envelope setting circuit and the output signal of the latch circuits 13-1 . . . 13-7 are added or subtracted at the accumulatively adding device 20 according to whether there is signal of INCREASE, DECREASE or EQUAL, whereby there is obtained a stepped form of musical-tone waveform, of which each step is the analog amount 6, as shown in FIG. 8.

If, then, the third address of the envelope setting circuit 42 is selected, a signal "00001000" is generated, and a stepped form of musical-tone waveform, of which the magnitude of each step is the analog amount 8, can be obtained.

Figure 9:
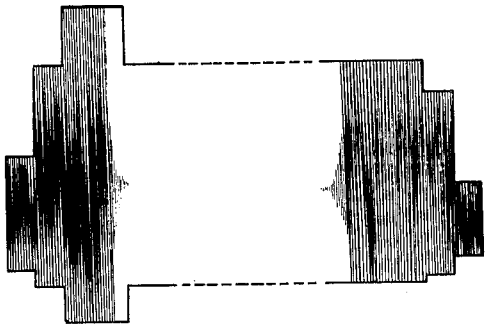
FIG. 9 is a diagram showing a musical tone signal having an envelope which is finally obtained.

Thus, if the envelope setting device 42 is operated until the sixteenth address, there can be obtained continuously a musical-tone waveform having the stepped form of envelope closely similar to the envelope desired to be produced, as shown in FIG. 9.

If a musical-tone waveform having a single envelope is drawn as mentioned above, the falling portion of a signal obtained at the final output terminal **41*b*-16 of the decoder 41 acts on the flip-flop circuit 47 to turn off the same, whereby the output thereof becomes "0". Thus, the AND gates 45 and 46 are closed and the counter 32 and the decoder 41** are stopped. Subsequent forming of the musical-tone waveform is not effected even if depression of the key is thereafter continued.

In the above explanation, the sampling points $a_1, a_2 \ldots a_{16}$ on the time axis of the musical tone waveform desired to be produced are memorized in each address of the portion 34A of the memory circuit 34 in such a manner that the numbers of the pulses thereof from the zero point $a_0$ are 6, 14, 35 . . . 80. Accordingly, the number of bits in the portion 34A of the memory circuit 34 is large and the number of the flip-flop circuits constituting the counter 32 also becomes large, for example, as large as seven.

Figure 10:
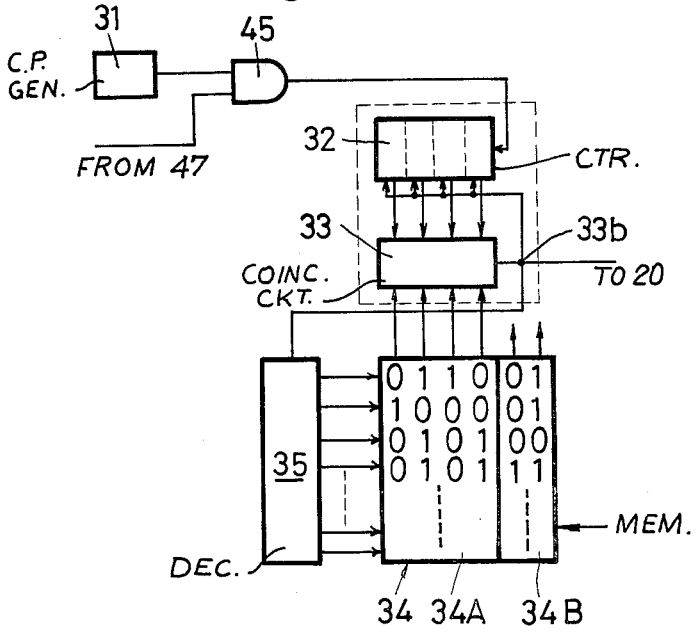
FIGS. 10 and 11 are each a block diagram showing another embodiment of this invention.

FIG. 10 shows a case where the same is of small size. In FIG. 10, the output terminal **33*b* of the coincidence circuit 33 is connected to reset terminals of the counter 32. The number of the flip-flop circuits constituting the counter 32 is four and the bits in the portion 34A of the memory circuit 34 are four in number. Additionally, in each address of the portion 34A, the numbers of the pulses between the sampling points $a_0 \ldots a_{16}$ are memorized in the form of digital signals. Thus, it is repeated that each time the numbers of the pulses distributed between the sampling points $a_0, a_1 \ldots a_{16}$ are counted by the counter 32, a coincidence signal is generated to reset, and thus there is obtained almost the same operation as in FIG. 1**.

Figure 11:
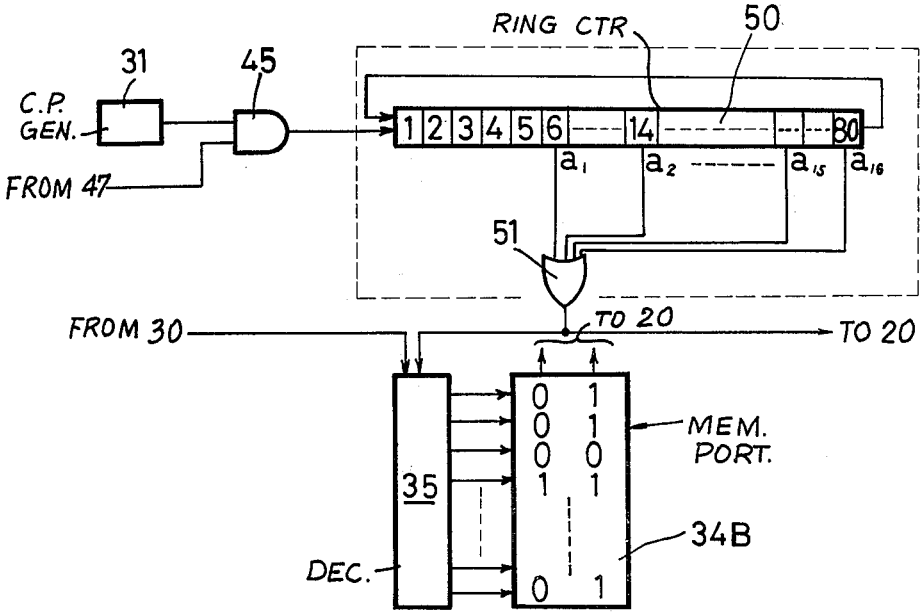

FIG. 11 shows another embodiment of this invention. In FIG. 11, the counter 32, the portion 34A of the memory circuit 34 and the coincidence circuit 33 in the embodiments of FIGS. 1 and 10 are omitted, and instead a single ring counter is provided. The ring counter 50 is an eighty stage counter of which one stage is cycled by counting 80 pulses, according to sampling of the musical-tone waveform (FIG. 3) which it is desired be produced. Respective output terminals are coupled to respective stages corresponding to the sampling points $a_1 \ldots a_{16}$. These output terminals are connected to an OR circuit 51, and an output terminal of the OR circuit 51 is connected to the decoder 35 and the accumulatively adding device 20 in almost the same manner as shown in FIG. 1. Respective output terminals of the decoder 35 are directly connected to the portion 34B. Thus, the ring counter 50 is advanced in operation stage-by-stage each time a pulse is applied thereto from the clock pulse generator 31, and there can be obtained outputs (corresponding to coincidence signals) through the OR circuit 51 from the respective stages corresponding to the sampling points $a_1, a_2 \ldots a_{16}$. These output signals operate in almost the same manner as in the example in FIG. 1 so as to effect the reproduction of the desired musical-tone waveform.

Figure 12:
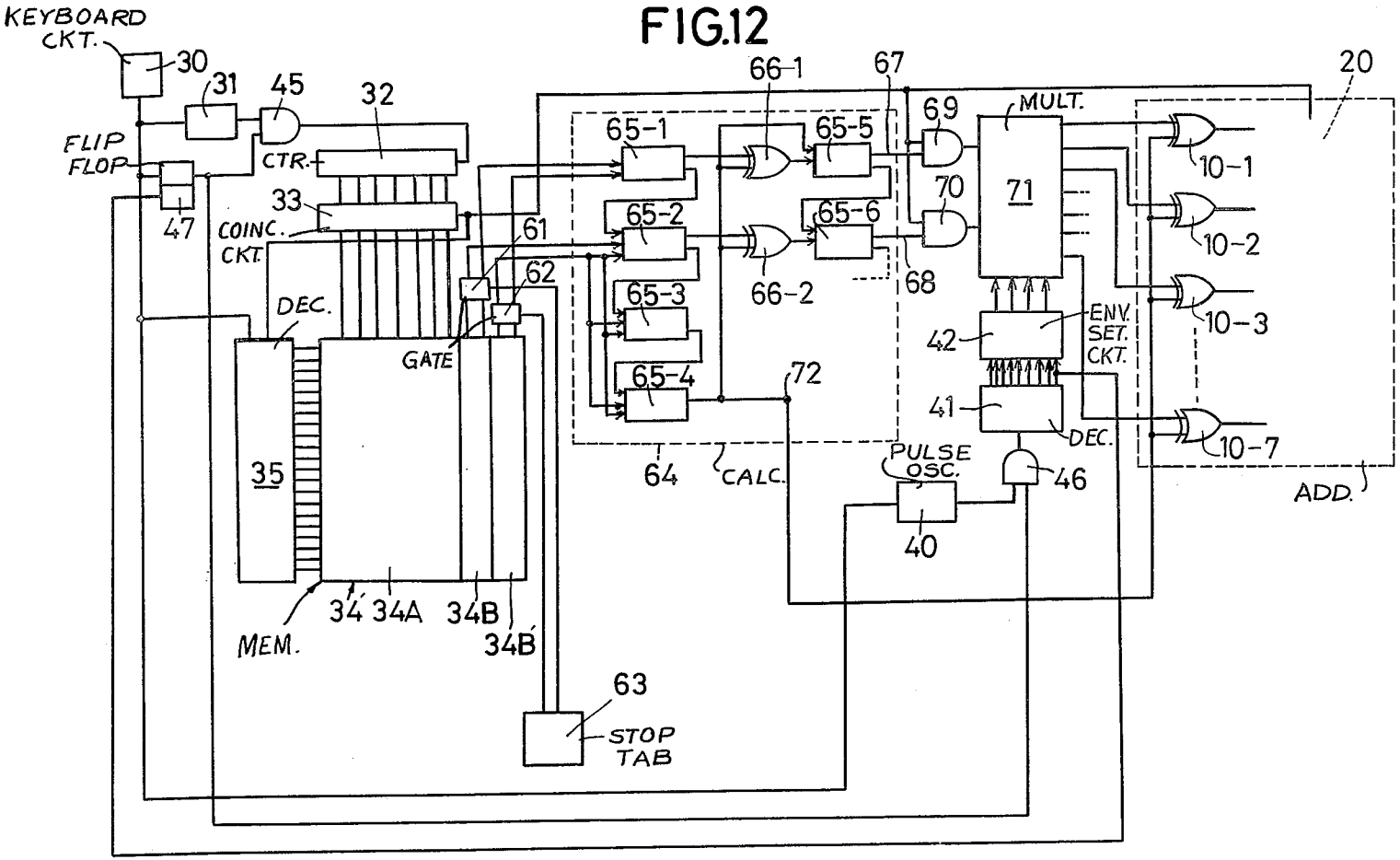
FIG. 12 is a block diagram showing another modified example of the invention.

FIG. 12 shows an example wherein two musical-tone waveforms to be produced are memorized and wherein it can be selectively effected that each waveform is separately reproduced or that these two are combined one with another for production of a composite waveform.

Figure 13A:
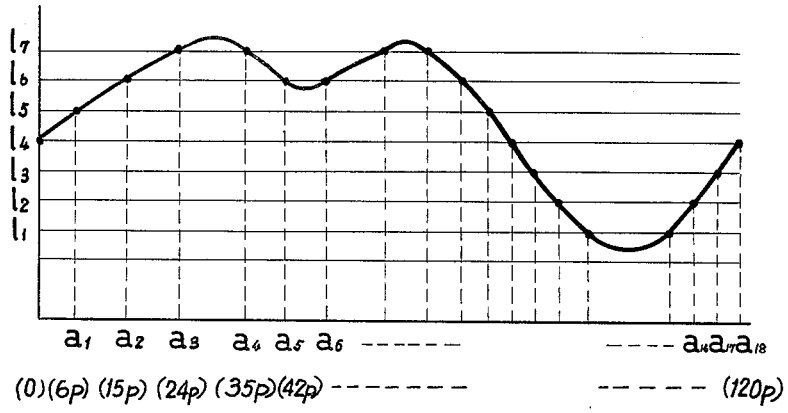
FIG. 13(A) and (B) are diagrams showing waveforms desired to be produced.
Figure 13:
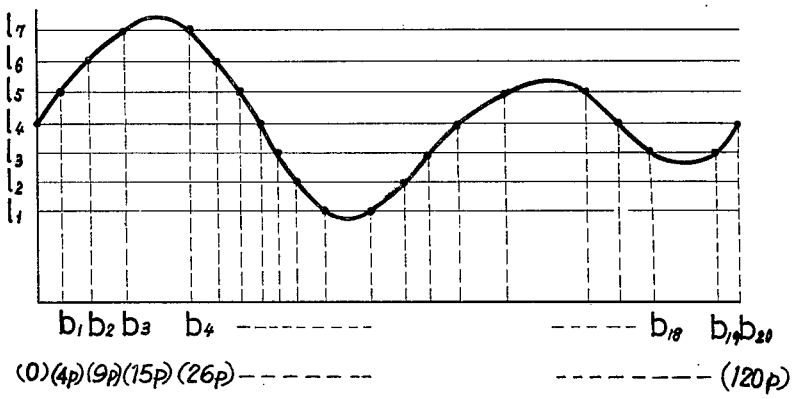
FIG. 13(C) is an explanation diagram relating to setting of two musical tone waveforms desired to be produced.
Figure 13C:
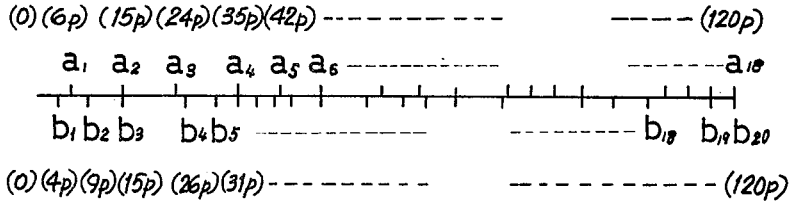
Figure 14:
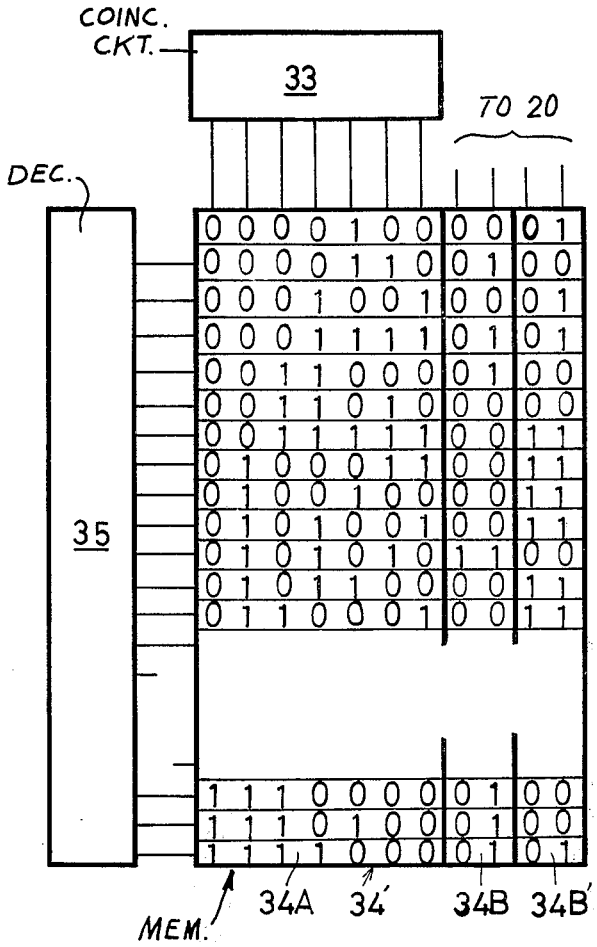
FIG. 14 is a diagram showing a set condition of another block.

FIGS. 13(A) and (B) show musical-tone waveforms to be produced. These waveforms are respectively divided by dividing lines $1_1, 1_2 \ldots 1_7$, in almost the same manner as in the case of FIG. 3. Perpendicular lines extend downwards from respective crossing points to determine on each time axis sampling points $a_1, a_2 \ldots a_{18}$ and $b_1, b_2 \ldots b_{20}$. The sampling points $a_1 \ldots a_{18}$ and $b_1 \ldots b_{20}$ are plotted on a common time axis as shown in FIG. 13(C). In memory circuit 34', there are provided a portion 34A wherein analog amounts of the sampling points $a_1 \ldots a_{18}, b_1 \ldots b_{20}$ on the common axis are set by digital signals of the binary scale and portions 34B and 34B' wherein tendencies such as INCREASE, DECREASE or EQUAL of the respective sampling points are set. The memory circuit 34' is composed of a read-only memory as mentioned above. If setting of the analog amount of each sampling point and that of its tendency are shown by digital signs, an arrangement as shown in FIG. 14 is obtained.

In FIG. 12, circuits 61 and 62 are gate circuits for selecting outputs of the portions 34B and 34B'. The gate circuits 61 and 62 are arranged to be controlled by operation of a stop tab 63. Circuit 64 is a calculation circuit for adding output signals of the two portions 34B and 34B' when the circuits 61 and 62 are simultaneously opened. Circuit 64 comprises a plurality of full adders 65-1 . . . 65-6 and two exclusive-OR circuits 66-1 and 66-2 so that there may be obtained outputs "00", "10" and "10" at output terminals 67 and 68 of the two full adders 65-6 and 65-6 at the latter stage according to the following truth table.

| Waveform A | | Waveform B | | Output terminals | | Output terminals |
|---|---|---|---|---|---|---|
| | | | | 68 | 67 | 72 |
| 0 | 1 | 0 | 1 | 1 | 0 | 0 |
| 0 | 1 | 0 | 0 | 0 | 1 | 0 |
| 0 | 1 | 1 | 1 | 0 | 0 | 0 |
| 1 | 1 | 0 | 1 | 0 | 0 | 0 |
| 1 | 1 | 0 | 0 | 0 | 1 | 1 |
| 1 | 1 | 1 | 1 | 1 | 0 | 1 |
| 0 | 0 | 0 | 1 | 0 | 1 | 0 |

-continued

| Waveform A | | Waveform B | | Output terminals | | Output terminals |
|---|---|---|---|---|---|---|
| 0 | 0 | 0 | 0 | 0 | 0 | 0 |
| 0 | 0 | 1 | 1 | 0 | 1 | 1 |

These output terminals 67 and 68 are connected to one input side of a multiplier 71 through respective AND gates 69 and 70 arranged to be opened by an output signal of the coincidence circuit 33. The other input side of the multiplier 71 is connected to a plurality of output terminals of the envelope setting circuit 43. A plurality of output terminals of the multiplier 71 are connected to one group of input terminals of a plurality of exclusive-OR circuits 10-1 . . . 10-7 of the accumulatively adding circuit 20. The other group of input terminals thereof are connected in common to an output terminal 72 of the full adder 65-4. The relation between the input to the calculation circuit 64 and the output at the output terminal 72 is as shown on the foregoing table.

The following explanation will be made about the case where the two gate circuits 61 and 62 are simultaneously opened and the two waveforms (A) and (B) are combined with one another for reproduction.

If a key is depressed, in almost the same manner as in the case shown in FIG. 1, the clock pulse generator 31 and the pulse oscillator 40 are driven and the first address of the memory circuit 34' and that of the envelope setting circuit 43 are selected. Output pulses of the clock pulse generator 31 are counted by the counter 32 in almost the same manner as in the case shown in FIG. 1 and each time an output signal thereof and an output signal from the portion 34A of the memory circuit 34' coincide, a coincidence signal is generated.

Figure 15A:
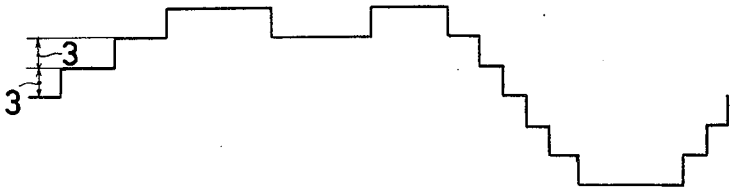
FIGS. 15(A) and (B) are diagrams showing resultant musical tone waveforms.
Figure 15B:
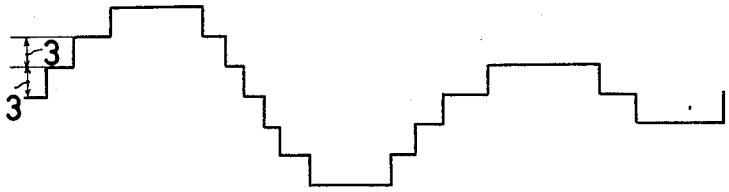
FIG. 15(C) is a diagram showing a composite of the two waveforms.
Figure 15C:
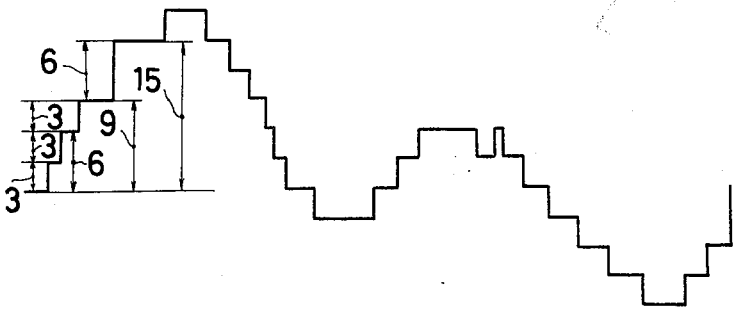

By the selection of the first address, output signals "00" "01" of the portions 34B and 34B' are calculated at the calculation circuit 64 so as to obtain an output "01" at the output terminals 67 and 68. If, then, a first coincidence signal is generated, the output "01" is applied to the multiplier 71 through the gate circuits 69 and 70. In this multiplier 71, the same is multiplied by an output signal "0011" of the first address of the envelope setting device 42 to provide an output "0000011". In the meanwhile, since the exclusive OR circuits 10-1 . . . 10-7 of the accumulatively adding device 20 are applied with an output "0" of the output terminal 72, the foregoing output signal "0000011" is memorized in and sent out from the latch circuits 13-1 . . . 13-7 at the falling portion of the first coincidence signal. There is obtained through the D-A converter 14 an analog amount "3" which is the word "0000011" of the first address of the envelope setting circuit 42 as shown in FIG. 15(C).

The falling portion of the first coincidence signal selects the second address of the memory circuit 34'. Since output signals of the portions 34B and 34B' are "01" and "00", the output of the calculation circuit 64 is "01" and after being passed through the AND gates 69 and 70 at the time of generation of the second coincidence signal, is multiplied by the output signal of the second address of the envelope setting circuit 42 to provide an output "0000011". Thus, similarly to the case of FIG. 1, the same is added with the output signal of the latch circuits 13-1 . . . 13-7 at the full adders 12-1 . . . 12-7 to provide an output "0000110". Thereby, there may be obtained an output of the analog amount "6" as shown in FIG. 15(C).

If the third address is selected by the falling portion of the second coincidence signal, "00" and "01" are taken out from the portions 34B and 34B' and the output of the calculation circuit 64 becomes "01". Similar to the above, by the third coincidence signal, "01" and "0000011" are multiplied at the multiplier 71 to obtain an output "0000011" and the same is added to an output "0000110" of the latch circuits 13-1 . . . 13-7 to obtain an output "0001001". This is a D-A converted to product an output of the analog amount "9". If the fourth address is selected by the falling portion of the third coincidence signal "01" and "01" are taken out from the portions 34B and 34B' and the output of the calculation circuit 64 becomes "10". The same is multiplied at the multiplier 71 by "0000011" at the fourth coincidence signal to obtain an output "0000110". This output is added to the output of the latch circuits 13-1 . . . 13-7 to obtain an output "0001111" and thus there is obtained an output of the analog amount "15". As is clear from FIG. 15(C), a rise of the analog amount 6 can be obtained following a stretch of three steps of a rise of the analog amount 3. Thus, the tendency signals of the two waveforms memorized in the portions 34B and 34B' of the memory circuit 34 are calculated at the calculation circuit 64 to obtain an output such as "00" "01" or "10". The same is multiplied by the output signal of the envelope setting circuit 42 and is applied to the accumulatively adding circuit 20, so that the two waveforms (FIGS. 3(A) and (B)) desired to be produced can be combined with one another to become a composite waveform as shown in FIG. 15(C).

In almost the same manner as in the case of FIG. 1, this waveform is varied in amplitude according to the word in each address of the envelope setting circuit 42 so that there can be obtained as a whole an envelope such as shown in FIG. 9.

The above has been explained relative to the case where the AND gates 61 and 62 are simultaneously opened for obtaining a composite wave. When either one is opened, however, the calculation circuit 64 operates according to the following table and thereby either one of the waveforms as shown in FIG. 15(A) or (B) can be obtained.

| | | Output terminals 68 | 67 | Output terminal 72 |
|---|---|---|---|---|
| 0 | 1 | 0 | 1 | 0 |
| 1 | 1 | 0 | 1 | 1 |
| 0 | 0 | 0 | 0 | 0 |

If the example of FIG. 12 is applied to the example of FIG. 10, the portion 34A of the memory circuit, the counter 32 and the coincidences circuit 33 can be simplified. It can be further simplified if the example of FIG. 11 is also applied thereto.

Thus, according to the invention, for each sampling point of a musical-tone waveform to be produced, a tendency such as increase, decrease or equal and each sampling point of an envelope are set so that, by depression of a key, a musical tone having an envelope can be obtained. Thus, a musical tone having any desired waveform and any desired envelope can be easily and assuredly obtained.

What is claimed is:

1. Apparatus for forming a musical-tone waveform for an electronic musical instrument, at least one cycle of said musical-tone waveform being divided in amplitude by dividing lines spaced at equal intervals, sampling points on time axis being determined from respective crossing points between the waveform and the dividing lines, distance between initial and final of the sampling points being represented as a number of pulses such that each sampling point can be represented by a pulse number, said waveform at each sampling point having an increase, decrease or equal tendency, said apparatus comprising memory means wherein the pulse number of each sampling point is set up in the form of a digital signal and wherein additionally said tendency is set up in the form of a digital signal, envelope setting means wherein an envelope of said musical-tone waveform is subjected to sampling and the analog amount of each sampling point is set up in the form of a digital signal, and accumulatively adding means wherein an output digital signal of the envelope setting means is accumulatively added to or subtracted from an output digital signal of said memory means and a D-A converter means, said accumulatively adding means being connected at its output to said D-A converter means for converting output signals into analog signals.

2. An apparatus as claimed in claim 1, wherein the said memory means includes at least two portions each adapted for the setting up of increase, decrease and equal tendencies of a waveform, and a calculation circuit means controlled by outputs of said two portions, said apparatus further including multiplier means, the output of the calculation circuit means and the output of the envelope setting means being multiplied by one another by said multiplier means and the resulting output thereof being applied to the said accumulatively adding means.

3. An apparatus as claimed in claim 1 wherein the accumulatively adding means comprises a plurality of AND circuits, exclusive-OR circuits, full adders and latch circuits coupled in operative association.

4. An apparatus as claimed in claim 1 comprising a clock pulse generator, a conicidence circuit coupled to said clock pulse generator, and a decoder, and wherein said memory means comprises a read-only memory, having a plurality of output terminals and a counter having a plurality of output terminals for counting output pulses of said clock pulse generator and connected to a coincidence circuit, the output of the coincidence circuit being connected to said decoder for designating addresses in the read-only memory and to said accumulatively adding device.

5. An apparatus as claimed in claim 1 comprising a decoder and a pulse oscillator and wherein the envelope setting means comprises a read-only memory, having an input connected to said decoder which is driven by output pulses of said pulse oscillator and designates addresses in order.

6. An apparatus as claimed in claim 1 wherein said memory means includes a single ring counter.

7. An apparatus as claimed in claim 2 wherein the accumulatively adding means comprises a plurality of AND circuits, exclusive-OR circuits, full adders and latch circuits coupled in operative association.

8. An apparatus as claimed in claim 2 comprising a clock pulse generator, a coincidence circuit coupled to said clock pulse generator, and a decoder, and wherein said memory means comprises a read-only memory, having a plurality of output terminals and a counter having a plurality of output terminals for counting output pulses of said clock pulse generator and connected to a coincidence circuit, the output of the coincidence circuit being connected to said decoder for designating addresses in the read-only memory and to said accumulatively adding device.

9. An apparatus as claimed in claim 2 comprising a decoder and a pulse oscillátor and wherein the envelope setting means comprises a read-only memory, having an input connected to said decoder which is driven by output pulses of said pulse oscillator and designates addresses in order.

10. An apparatus as claimed in claim 4, wherein the said counter includes a programmable counter that is automatically reset when one cycle of the musical tone waveform is concluded.

11. An apparatus as claimed in claim 4, wherein the said counter includes means to be reset by an output signal of the coincidence circuit whereby the number of bits required in the memory means is decreased.

12. A method for forming a cycle of a musical-tone waveform comprising intersecting with the waveform of said cycle equally spaced amplitude dividing lines, representing the time extent of said cycle by a sequence of regularly spaced pulses, representing intersections between said lines and waveform by respective pulses having respective numbers in said sequence, and identifying at each intersection the tendency of the waveform to increase, decrease or remain constant in amplitude, storing the pulse numbers and tendencies as available information, and reconstructing the waveform from said information.

13. A method as claimed in claim 12 comprising storing the information in the form of digital signals.

14. A method as claimed in claim 13 comprising reconstructing the waveform by a digital to analog conversion based on said digital signals.

* * * * *